US008677753B2

(12) United States Patent
Melton et al.

(10) Patent No.: US 8,677,753 B2
(45) Date of Patent: Mar. 25, 2014

(54) SYSTEM FOR SUPPLYING A WORKING FLUID TO A COMBUSTOR

(75) Inventors: Patrick Benedict Melton, Horse Shoe, NC (US); John Charles Intile, Simpsonville, SC (US); Lucas John Stoia, Taylors, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/466,184

(22) Filed: May 8, 2012

(65) Prior Publication Data

US 2013/0298560 A1 Nov. 14, 2013

(51) Int. Cl.
*F02C 1/00* (2006.01)

(52) U.S. Cl.
USPC ..... 60/733

(58) Field of Classification Search
CPC ..... F01D 9/023; F23R 3/34; F23R 3/283; F23R 3/286; F23C 6/047
USPC ..... 60/39.37, 733, 737, 740, 746, 747
See application file for complete search history.

(56) References Cited

U.S. PATENT DOCUMENTS

| | | | | |
|---|---|---|---|---|
| 2,922,279 | A | | 1/1960 | Roberson et al. |
| 3,934,409 | A | | 1/1976 | Quillevere et al. |
| 4,040,252 | A | | 8/1977 | Mosier et al. |
| 4,045,956 | A | | 9/1977 | Markowski et al. |
| 4,112,676 | A | | 9/1978 | DeCorso |
| 4,253,301 | A | | 3/1981 | Vogt |
| 4,288,980 | A | | 9/1981 | Ernst |
| 4,928,481 | A | | 5/1990 | Joshi et al. |
| 5,054,280 | A | | 10/1991 | Ishibashi et al. |
| 5,099,644 | A | | 3/1992 | Sabla et al. |
| 5,127,229 | A | | 7/1992 | Ishibashi et al. |
| 5,297,391 | A | | 3/1994 | Roche |
| 5,321,948 | A | | 6/1994 | Leonard |
| 5,623,819 | A | * | 4/1997 | Bowker et al. ..... 60/776 |
| 5,749,219 | A | | 5/1998 | DuBell |
| 5,974,781 | A | | 11/1999 | Correa et al. |
| 6,047,550 | A | | 4/2000 | Beebe |
| 6,178,737 | B1 | | 1/2001 | Lenertz et al. |
| 6,192,688 | B1 | | 2/2001 | Beebe |

(Continued)

FOREIGN PATENT DOCUMENTS

| | | |
|---|---|---|
| EP | 2236935 | 6/2010 |
| EP | 2206964 A2 | 7/2012 |

(Continued)

OTHER PUBLICATIONS

EP International Search Report for application No. EP 13166361 dated Nov. 8, 2013.

(Continued)

*Primary Examiner* — Phutthiwat Wongwian
(74) *Attorney, Agent, or Firm* — Dority & Manning, P.A.

(57) ABSTRACT

A system for supplying a working fluid to a combustor includes a fuel nozzle, a combustion chamber downstream from the fuel nozzle, and a flow sleeve that circumferentially surrounds the combustion chamber. A plurality of fuel injectors are circumferentially arranged around the flow sleeve to provide fluid communication through the flow sleeve to the combustion chamber. A distribution manifold circumferentially surrounds the plurality of fuel injectors, and a fluid passage through the flow sleeve and into the distribution manifold provides fluid communication through the flow sleeve to the plurality of fuel injectors.

17 Claims, 6 Drawing Sheets

(56) References Cited

U.S. PATENT DOCUMENTS

| | | | | |
|---|---|---|---|---|
| 6,253,538 | B1 | 7/2001 | Sampath et al. | |
| 6,868,676 | B1 | 3/2005 | Haynes | |
| 6,925,809 | B2 | 8/2005 | Mowill | |
| 6,935,116 | B2 | 8/2005 | Stuttaford et al. | |
| 7,137,256 | B1 | 11/2006 | Stuttaford et al. | |
| 7,162,875 | B2 * | 1/2007 | Fletcher et al. | 60/773 |
| 7,237,384 | B2 | 7/2007 | Stuttaford et al. | |
| 7,425,127 | B2 | 9/2008 | Zinn | |
| 7,665,309 | B2 | 2/2010 | Parker et al. | |
| 8,475,160 | B2 * | 7/2013 | Campbell et al. | 431/2 |
| 2005/0095542 | A1 | 5/2005 | Sanders et al. | |
| 2005/0097889 | A1 | 5/2005 | Pilatis et al. | |
| 2007/0022758 | A1 | 2/2007 | Myers et al. | |
| 2007/0137207 | A1 | 6/2007 | Mancini et al. | |
| 2009/0084082 | A1 | 4/2009 | Martin et al. | |
| 2010/0018208 | A1 * | 1/2010 | Ritland | 60/737 |
| 2010/0018209 | A1 * | 1/2010 | Ramier et al. | 60/740 |
| 2010/0174466 | A1 | 7/2010 | Davis, Jr. et al. | |
| 2011/0056206 | A1 * | 3/2011 | Wiebe | 60/740 |
| 2011/0067402 | A1 * | 3/2011 | Wiebe et al. | 60/740 |
| 2011/0131998 | A1 | 6/2011 | Nadkarni et al. | |
| 2011/0179803 | A1 | 7/2011 | Berry et al. | |
| 2011/0296839 | A1 | 12/2011 | Van Nieuwenhuizen et al. | |
| 2013/0008169 | A1 * | 1/2013 | Belsom et al. | 60/740 |

FOREIGN PATENT DOCUMENTS

| | | | |
|---|---|---|---|
| EP | 2613082 | | 10/2013 |
| JP | 2006138566 | | 6/2006 |
| WO | 2004/035187 | A2 | 4/2004 |

OTHER PUBLICATIONS

Co-pending U.S. Appl. No. 13/417,405, Chen et al., filed Mar. 12, 2012.

Co-pending U.S. Appl. No. 13/349,886, Stoia, et al., filed Jan. 13, 2012.

Co-pending U.S. Appl. No. 13/344,877, Stoia, et al., filed Jan. 6, 2012.

Co-pending U.S. Appl. No. 13/349,906, Stoia, et al., filed Jan. 13, 2012.

Co-pending U.S. Appl. No. 13/420,715, Chen, at al., filed Mar. 15, 2012.

Co-pending U.S. Appl. No. 13/455,429, Romig, et al., filed Apr. 25, 2012.

Co-pending U.S. Appl. No. 13/455,480, Stoia, et al., filed Apr. 25, 2012.

Co-pending U.S. Appl. No. 14/122,694, Shershnyov, filed Nov. 27, 2013.

Co-pending U.S. Appl. No. 14/122,697, Shershrivov, filed Nov. 27, 2013.

* cited by examiner

SYSTEM FOR SUPPLYING A WORKING FLUID TO A COMBUSTOR

FIELD OF THE INVENTION

The present invention generally involves a system and method for supplying a working fluid to a combustor.

BACKGROUND OF THE INVENTION

Combustors are commonly used in industrial and power generation operations to ignite fuel to produce combustion gases having a high temperature and pressure. For example, gas turbines typically include one or more combustors to generate power or thrust. A typical gas turbine used to generate electrical power includes an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows through one or more fuel nozzles into a combustion chamber in each combustor where the compressed working fluid mixes with fuel and ignites to generate combustion gases having a high temperature and pressure. The combustion gases expand in the turbine to produce work. For example, expansion of the combustion gases in the turbine may rotate a shaft connected to a generator to produce electricity.

Various design and operating parameters influence the design and operation of combustors. For example, higher combustion gas temperatures generally improve the thermodynamic efficiency of the combustor. However, higher combustion gas temperatures also promote flame holding conditions in which the combustion flame migrates toward the fuel being supplied by the fuel nozzles, possibly causing accelerated wear to the fuel nozzles in a relatively short amount of time. In addition, higher combustion gas temperatures generally increase the disassociation rate of diatomic nitrogen, increasing the production of nitrogen oxides ($NO_X$). Conversely, a lower combustion gas temperature associated with reduced fuel flow and/or part load operation (turndown) generally reduces the chemical reaction rates of the combustion gases, increasing the production of carbon monoxide and unburned hydrocarbons.

In a particular combustor design, one or more fuel injectors, also known as late lean injectors, may be circumferentially arranged around the combustion chamber downstream from the fuel nozzles. A portion of the compressed working fluid exiting the compressor may flow through the fuel injectors to mix with fuel to produce a lean fuel-air mixture. The lean fuel-air mixture may then be injected into the combustion chamber for additional combustion to raise the combustion gas temperature and increase the thermodynamic efficiency of the combustor.

The late lean injectors are effective at increasing combustion gas temperatures without producing a corresponding increase in the production of $NO_X$. However, the pressure and flow of the compressed working fluid exiting the compressor may vary substantially around the circumference of the combustion chamber. As a result, the fuel-air ratio flowing through the late lean injectors can vary considerably, mitigating the beneficial effects otherwise created by the late lean injection of fuel into the combustion chamber. In addition, the compressed working fluid exiting the compressor is often directed or channeled around the outside of the combustion chamber to convectively remove heat from the combustion chamber before flowing through the fuel nozzles. As a result, the portion of the compressed working fluid diverted through the late lean injectors may reduce the amount of cooling provided to the outside of the combustion chamber. Therefore, an improved system and method for more evenly supplying the compressed working fluid to the combustor through the late lean injectors without reducing the cooling provided to the combustion chamber would be useful.

BRIEF DESCRIPTION OF THE INVENTION

Aspects and advantages of the invention are set forth below in the following description, or may be obvious from the description, or may be learned through practice of the invention.

One embodiment of the present invention is a system for supplying a working fluid to a combustor that includes a fuel nozzle, a combustion chamber downstream from the fuel nozzle, and a flow sleeve that circumferentially surrounds the combustion chamber. A plurality of fuel injectors are circumferentially arranged around the flow sleeve to provide fluid communication through the flow sleeve to the combustion chamber. A distribution manifold circumferentially surrounds the plurality of fuel injectors, and a fluid passage through the flow sleeve and into the distribution manifold provides fluid communication through the flow sleeve to the plurality of fuel injectors.

Another embodiment of the present invention is a system for supplying a working fluid to a combustor that includes a combustion chamber, a liner that circumferentially surrounds the combustion chamber, and a flow sleeve that circumferentially surrounds the liner. A distribution manifold circumferentially surrounds the flow sleeve, and a plurality of fuel injectors circumferentially arranged around the flow sleeve provide fluid communication through the flow sleeve and the liner to the combustion chamber. A fluid passage through the flow sleeve provides fluid communication through the flow sleeve to the plurality of fuel injectors.

The present invention may also include a system for supplying a working fluid to a combustor that includes a fuel nozzle, a combustion chamber downstream from the fuel nozzle, and a liner that circumferentially surrounds the combustion chamber. A first annular passage circumferentially surrounds the liner, and a second annular passage circumferentially surrounds the first annular passage. A fluid passage is between the first annular passage and the second annular passage. A plurality of fuel injectors circumferentially arranged around the liner provide fluid communication from the second annular passage, through the liner, and into the combustion chamber.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
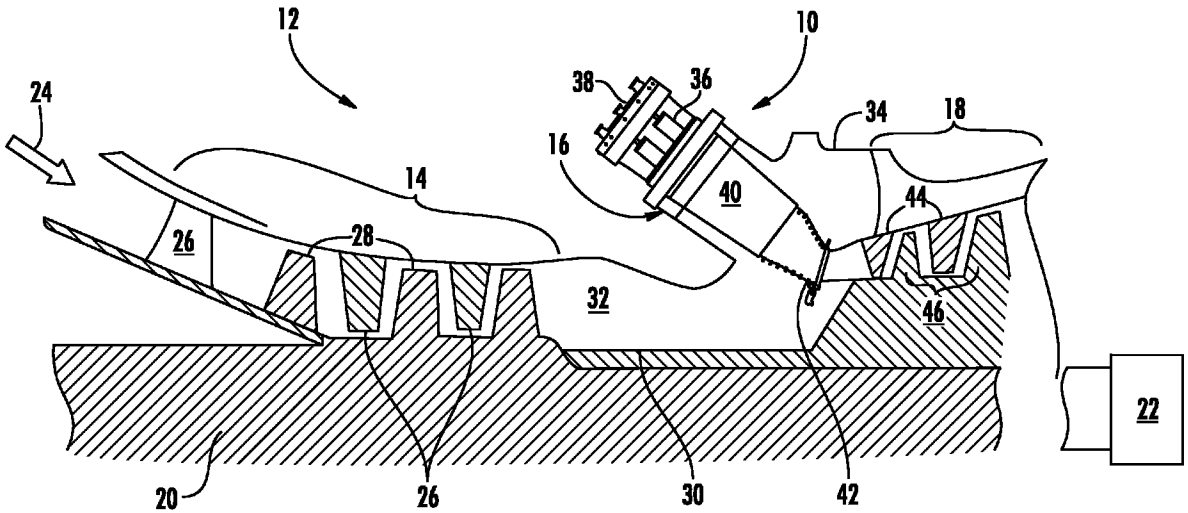
FIG. 1 is a simplified side cross-section view of a system according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system and method for supplying a working fluid to a combustor. In general, the system includes multiple late lean injectors that circumferentially surround a combustion chamber. The system diverts or flows a portion of the working fluid along the outside of the combustion chamber and through a distribution manifold that circumferentially surrounds the late lean injectors to reduce variations in the pressure and/or flow rate of the working fluid reaching the late lean injectors. One or more baffles may be included inside the distribution manifold to further distribute and equalize the pressure and/or flow rate of the working fluid circumferentially around the combustion chamber. As a result, the system reduces variations in the pressure and/or flow rate of the working fluid flowing through each late lean injector to produce a more uniform fuel-air mixture injected into the combustion chamber. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

FIG. 1 provides a simplified cross-section view of a system 10 according to one embodiment of the present invention. As shown, the system 10 may be incorporated into a gas turbine 12 having a compressor 14 at the front, one or more combustors 16 radially disposed around the middle, and a turbine 18 at the rear. The compressor 14 and the turbine 18 typically share a common rotor 20 connected to a generator 22 to produce electricity.

The compressor 14 may be an axial flow compressor in which a working fluid 24, such as ambient air, enters the compressor 14 and passes through alternating stages of stationary vanes 26 and rotating blades 28. A compressor casing 30 contains the working fluid 24 as the stationary vanes 26 and rotating blades 28 accelerate and redirect the working fluid 24 to produce a continuous flow of compressed working fluid 24. The majority of the compressed working fluid 24 flows through a compressor discharge plenum 32 to the combustor 16.

The combustor 16 may be any type of combustor known in the art. For example, as shown in FIG. 1, a combustor casing 34 may circumferentially surround some or all of the combustor 16 to contain the compressed working fluid 24 flowing from the compressor 14. One or more fuel nozzles 36 may be radially arranged in an end cover 38 to supply fuel to a combustion chamber 40 downstream from the fuel nozzles 36. Possible fuels include, for example, one or more of blast furnace gas, coke oven gas, natural gas, vaporized liquefied natural gas (LNG), hydrogen, and propane. The compressed working fluid 24 may flow from the compressor discharge plenum 32 along the outside of the combustion chamber 40 before reaching the end cover 38 and reversing direction to flow through the fuel nozzles 36 to mix with the fuel. The mixture of fuel and compressed working fluid 24 flows into the combustion chamber 40 where it ignites to generate combustion gases having a high temperature and pressure. The combustion gases flow through a transition piece 42 to the turbine 18.

The turbine 18 may include alternating stages of stators 44 and rotating buckets 46. The first stage of stators 44 redirects and focuses the combustion gases onto the first stage of buckets 46. As the combustion gases pass over the first stage of buckets 46, the combustion gases expand, causing the buckets 46 and rotor 20 to rotate. The combustion gases then flow to the next stage of stators 44 which redirects the combustion gases to the next stage of rotating buckets 46, and the process repeats for the following stages.

Figure 2:
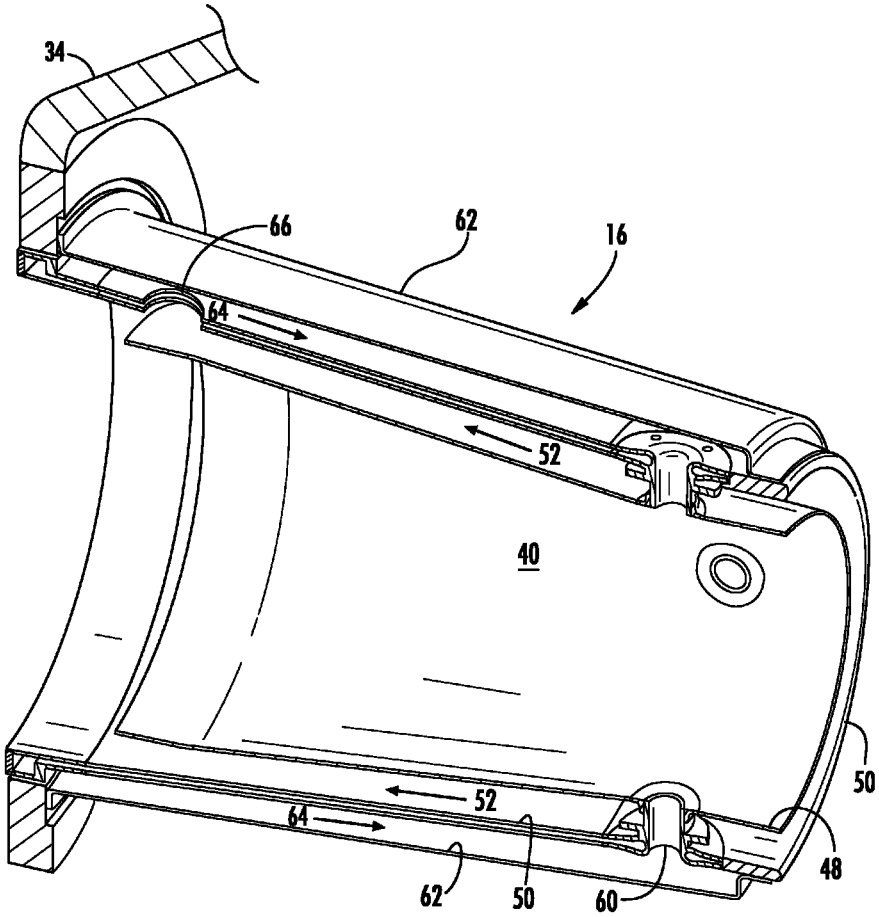
FIG. 2 is a simplified side cross-section view of a portion of the combustor shown in FIG. 1 according to a first embodiment of the present invention.

FIG. 2 provides a simplified side cross-section view of a portion of the combustor 16 shown in FIG. 1 according to a first embodiment of the present invention. As shown, the combustor 16 may include a liner 48 that circumferentially surrounds at least a portion of the combustion chamber 40, and a flow sleeve 50 may circumferentially surround the liner 48 to define a first annular passage 52 that surrounds the liner 48. In this manner, the compressed working fluid 24 from the compressor discharge plenum 32 may flow through the first annular passage 52 along the outside of the liner 48 to provide convective cooling to the liner 48 before reversing direction to flow through the fuel nozzles 36 (shown in FIG. 1) and into the combustion chamber 40.

The combustor 16 may further include a plurality of fuel injectors 60 circumferentially arranged around the combustion chamber 40, liner 48, and flow sleeve 50 downstream from the fuel nozzles 36. The fuel injectors 60 provide fluid communication through the liner 48 and the flow sleeve 50 and into the combustion chamber 40. The fuel injectors 60 may receive the same or a different fuel than supplied to the fuel nozzles 36 and mix the fuel with a portion of the compressed working fluid 24 before or while injecting the mixture into the combustion chamber 40. In this manner, the fuel injectors 60 may supply a lean mixture of fuel and compressed working fluid 24 for additional combustion to raise the temperature, and thus the efficiency, of the combustor 16.

A distribution manifold 62 circumferentially surrounds the fuel injectors 60 to shield the fuel injectors 60 from direct impingement by the compressed working fluid 24 flowing out of the compressor 14. The distribution manifold 62 may be press fit or otherwise connected to the combustor casing 34 and/or around a circumference of the flow sleeve 50 to provide a substantially enclosed volume or second annular passage 64 between the distribution manifold 62 and the flow sleeve 50. The distribution manifold 62 may extend axially along a portion or the entire length of the flow sleeve 50. In the particular embodiment shown in FIG. 2, for example, the distribution manifold 62 extends axially along the entire length of the flow sleeve 50 so that the distribution manifold 62 is substantially coextensive with the flow sleeve 50.

One or more fluid passages 66 through the flow sleeve 50 may provide fluid communication through the flow sleeve 50 to the second annular passage 64 between the distribution manifold 62 and the flow sleeve 50. A portion of the compressed working fluid 24 may thus be diverted or flow through the fluid passages 66 and into the second annular passage 64. As the compressed working fluid 24 flows around the flow sleeve 50 inside the second annular passage 64, variations in the pressure and/or flow rate of the working fluid 24 reaching the fuel injectors 60 are reduced to produce a more uniform fuel-air mixture injected into the combustion chamber 40.

Figure 3:
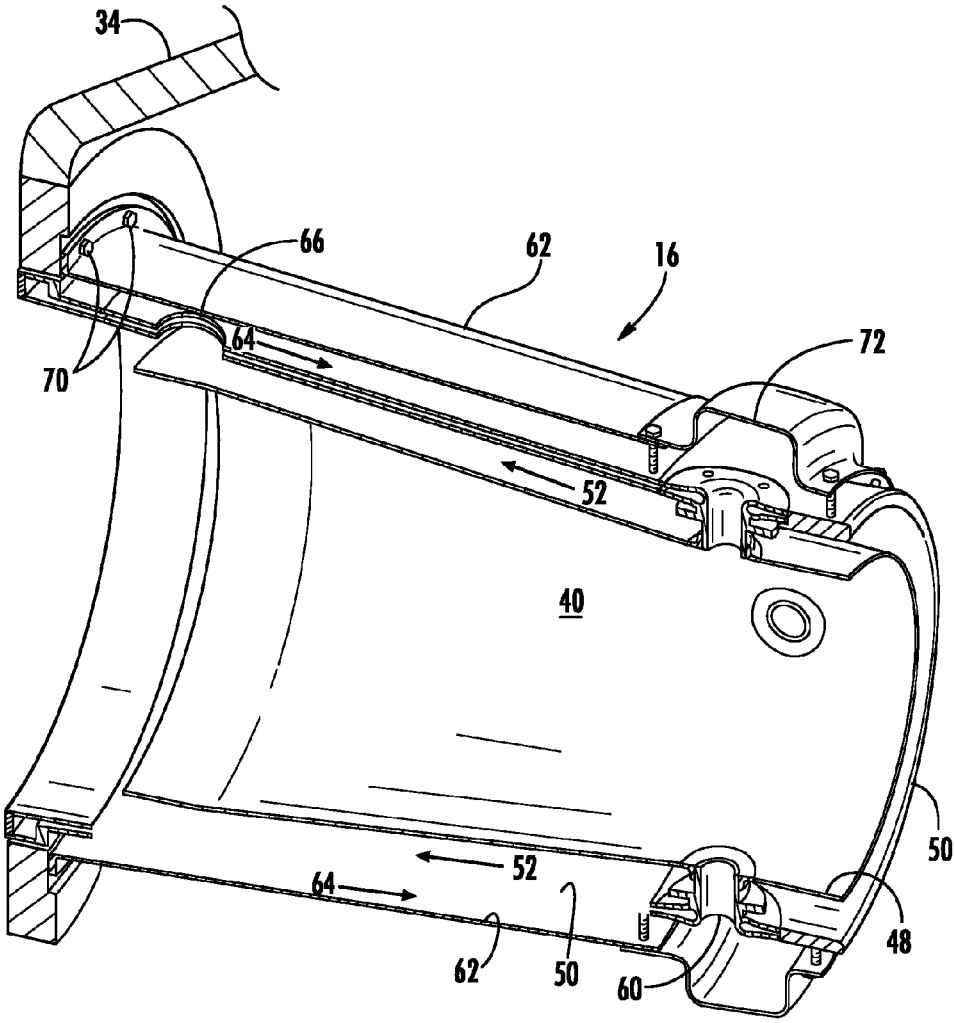
FIG. 3 is a simplified side cross-section view of a portion of the combustor shown in FIG. 1 according to a second embodiment of the present invention.
Figure 4:
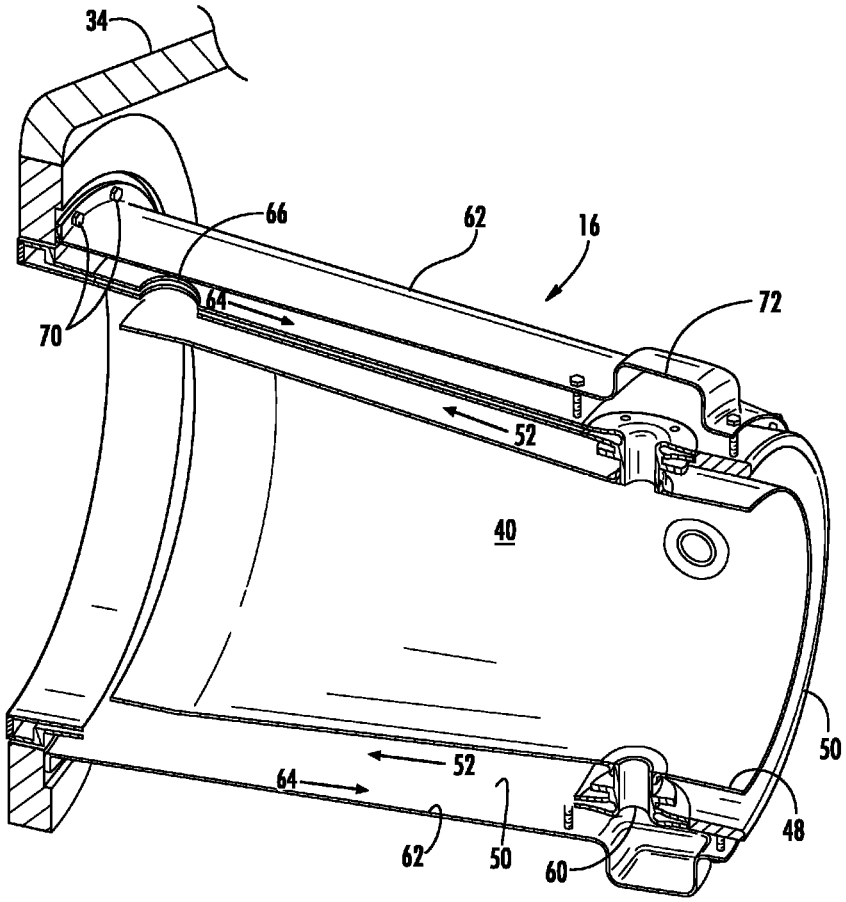
FIG. 4 is a simplified side cross-section view of a portion of the combustor shown in FIG. 1 according to a third embodiment of the present invention.

FIGS. 3 and 4 provide simplified side cross-section views of a portion of the combustor 16 shown in FIG. 1 according to alternate embodiments of the present invention. As shown, the combustor 16 again includes the liner 48, flow sleeve 50, first annular passage 52, fuel injectors 60, distribution manifold 62, second annular passage 64, and fluid passages 66 as previously described with respect to the embodiment shown in FIG. 2. In these particular embodiments, a plurality of bolts 70 are used to connect one end of the distribution manifold 62 to the combustor casing 34. In addition, the distribution manifold 62 includes a radial projection 72 proximate to and axially aligned with the fuel injectors 60. The radial projection 72 may be integral with the distribution manifold 62, as shown in FIG. 3, or may be a separate sleeve, collar, or similar device connected to the distribution manifold 62 and/or flow sleeve 50, as shown in FIG. 4. In addition, the radial projection 72 may circumferentially surround the flow sleeve 50, as shown in FIG. 3, or may exist coincidental with the fuel injectors 60, as shown in FIG. 4. In either event, the radial projection 72 functionally provides additional clearance between the distribution manifold 62 and the fuel injectors 60. This clearance may operatively reduce variations in the pressure and/or flow rate of the compressed working fluid 24 reaching the fuel injectors 60 which may yield a more uniform fuel-air mixture that is injected into the combustion chamber 40.

Figure 5:
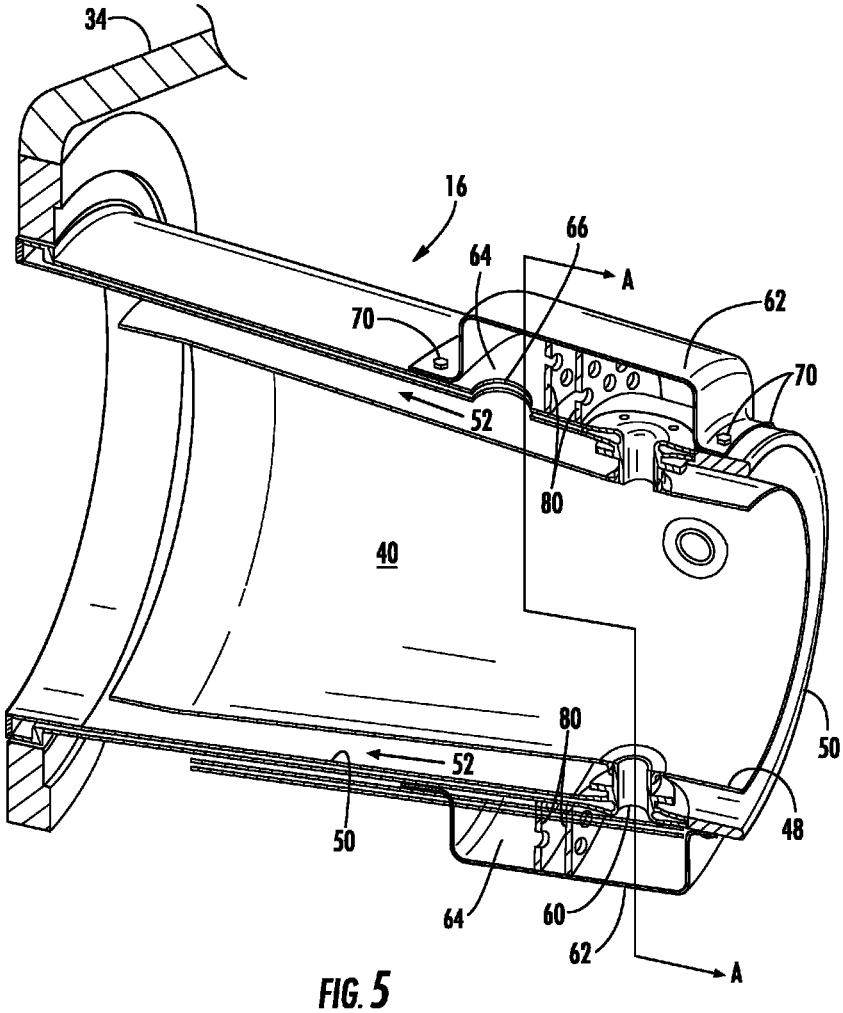
FIG. 5 is a simplified side cross-section view of a portion of the combustor shown in FIG. 1 according to a fourth embodiment of the present invention.

FIG. 5 provides a simplified side cross-section view of a portion of the combustor 16 shown in FIG. 1 according to an alternate embodiment of the present invention. As shown in FIG. 5, the distribution manifold 62 again circumferentially surrounds the flow sleeve 50 and/or fuel injectors 60 to shield the fuel injectors 60 from direct impingement by the compressed working fluid 24 flowing out of the compressor 14. In addition, the fluid passages 66 through the flow sleeve 50 again allow a portion of the compressed working fluid 24 to flow through the first annular passage 52, through the flow sleeve 50, and inside the second annular passage 64 before reaching the fuel injectors 60. In this particular embodiment, however, the distribution manifold 62 covers only a fraction of the flow sleeve 50. For example, the distribution manifold 62 may extend axially less than approximately 75%, 50%, or 25% of an axial length of the flow sleeve 50. In addition, one or more baffles 80 extend radially between the flow sleeve 50 and the distribution manifold 62. The baffles 80 may connect to the flow sleeve 50 and/or the distribution manifold 62, may extend circumferentially around some or all of the flow sleeve 50, and/or may include passages or holes to enhance distribution of the compressed working fluid 24 around the flow sleeve 50. In this manner, the baffles 80 may reduce variations in the pressure and/or flow rate of the compressed working fluid 24 reaching the fuel injectors 60 to produce a more uniform fuel-air mixture injected into the combustion chamber 40.

Figure 6:
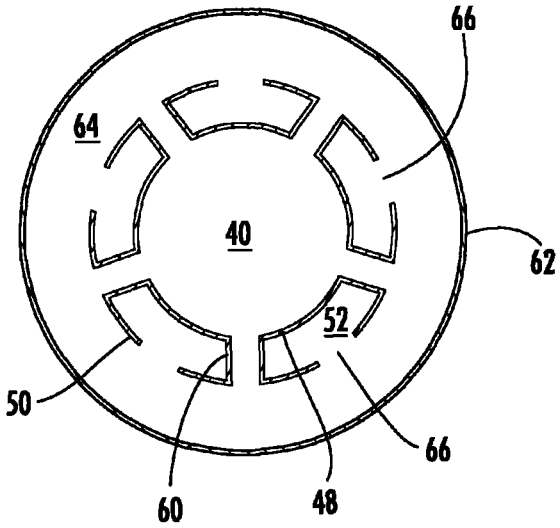
FIG. 6 is an axial cross-section view of the combustor shown in FIG. 5 taken along line A-A according to one embodiment of the present invention.
Figure 7:
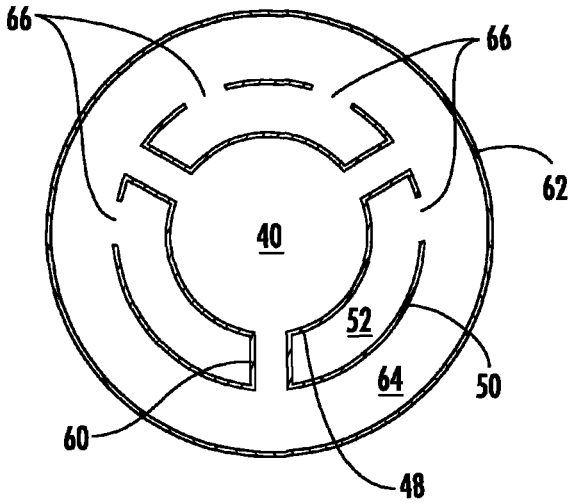
FIG. 7 is an axial cross-section view of the combustor shown in FIG. 5 taken along line A-A according to an alternate embodiment of the present invention.

FIGS. 6 and 7 provide axial cross-section views of the combustor 16 shown in FIG. 5 taken along line A-A according to various embodiments of the present invention. As shown in FIG. 6, the fluid passages 66 may be evenly spaced around the flow sleeve 50 and/or staggered circumferentially with respect to the fuel injectors 60. The even spacing of the fluid passages 66 may be useful in applications in which the pressure and/or flow of the compressed working fluid 24 does not vary excessively around the circumference of the flow sleeve 50 and/or the baffles 80 adequately distribute the compressed working fluid 24 inside the second annular passage 64 to sufficiently reduce any variations in the pressure and/or flow rate of the compressed working fluid 24 reaching the fuel injectors 60. Alternately, as shown in FIG. 7, the fluid passages 66 may be spaced at different intervals circumferentially around the flow sleeve 50. The uneven spacing between the fluid passages 66 may be useful in applications in which the static pressure of the compressed working fluid 24 varies excessively around the circumference of the flow sleeve 50 and/or the baffles 80 do not adequately distribute the compressed working fluid 24 inside the second annular passage 64 to sufficiently reduce any variations in the pressure and/or flow rate of the compressed working fluid 24 reaching the fuel injectors 60.

The system 10 shown and described with respect to FIGS. 1-7 may also provide a method for supplying the working fluid 24 to the combustor 16. The method may include flowing the working fluid 24 from the compressor 14 through the first annular passage 52 that circumferentially surrounds the combustion chamber 40 and liner 48. The method may further include diverting a portion of the working fluid 24 through the fluid passages 66 in the flow sleeve 50, into the second annular passage 64 between the flow sleeve 50 and the distribution manifold 62, and through fuel injectors 60 circumferentially arranged around the combustion chamber 40. In particular embodiments, the method may further include flowing the diverted portion of the working fluid 24 across the baffle 80 that extends radially and/or circumferentially inside the distribution manifold 62 to distribute the diverted working fluid 24 substantially evenly around the combustion chamber 40.

The various embodiments of the present invention may provide one or more technical advantages over existing late lean injection systems. For example, the systems and methods described herein may reduce variations in the pressure and/or flow of the working fluid 24 through each fuel injector 60. As a result, the various embodiments require less analysis to achieve the desired fuel-air ratio through the fuel injectors 60 and enhance the intended ability of the fuel injectors 60 achieve the desired efficiency and reduced emissions from the combustor 16. In addition, the various embodiments described herein may supply the working fluid 24 to the fuel injectors 60 without reducing the amount of cooling provided by the working fluid 24 to the combustion chamber 40.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for supplying a working fluid to a combustor, comprising:

a. a fuel nozzle;

b. a combustion chamber downstream from the fuel nozzle;

c. a flow sleeve that circumferentially surrounds the combustion chamber;

d. a plurality of fuel injectors circumferentially arranged around the flow sleeve, wherein the plurality of fuel injectors provide fluid communication through the flow sleeve to the combustion chamber;

e. a distribution manifold that circumferentially surrounds the plurality of fuel injectors;

f. a fluid passage through the flow sleeve and into the distribution manifold, wherein the fluid passage provides fluid communication through the flow sleeve to the plurality of fuel injectors; and g. wherein the distribution manifold is directly connected to the flow sleeve around a circumference of the flow sleeve.

2. The system as in claim 1, wherein the distribution manifold is substantially coextensive with the flow sleeve.

3. The system as in claim 1, further comprising a baffle between the flow sleeve and the distribution manifold.

4. The system as in claim 3, wherein the baffle extends radially between the flow sleeve and the distribution manifold.

5. The system as in claim 3, wherein the baffle extends circumferentially around the flow sleeve.

6. The system as in claim 1, further comprising a plurality of fluid passages through the flow sleeve, wherein the plurality of fluid passages provide fluid communication through the flow sleeve to the plurality of fuel injectors.

7. The system as in claim 6, wherein the plurality of fluid passages is evenly spaced circumferentially around the flow sleeve.

8. A system for supplying a working fluid to a combustor, comprising:

a. a combustion chamber;

b. a liner that circumferentially surrounds the combustion chamber;

c. a flow sleeve that circumferentially surrounds the liner;

d. a distribution manifold that circumferentially surrounds the flow sleeve;

e. a plurality of fuel injectors circumferentially arranged around the flow sleeve, wherein the plurality of fuel injectors provide fluid communication through the flow sleeve and the liner to the combustion chamber;

f. a fluid passage through the flow sleeve, wherein the fluid passage provides fluid communication through the flow sleeve to the plurality of fuel injectors; and g. a baffle between the flow sleeve and the distribution manifold.

9. The system as in claim 8, wherein the distribution manifold extends axially less than approximately 50% of an axial length of the flow sleeve.

10. The system as in claim 8, wherein the distribution manifold is connected to the flow sleeve around a circumference of the flow sleeve.

11. The system as in claim 8, wherein the baffle extends radially from the flow sleeve to the distribution manifold.

12. The system as in claim 8, wherein the baffle extends circumferentially around the flow sleeve.

13. The system as in claim 8, further comprising a plurality of fluid passages through the flow sleeve, wherein the plurality of fluid passages provide fluid communication through the flow sleeve to the plurality of fuel injectors.

14. The system as in claim 13, wherein the plurality of fluid passages is spaced at different intervals circumferentially around the flow sleeve.

15. A system for supplying a working fluid to a combustor, comprising:

a. a fuel nozzle;

b. a combustion chamber downstream from the fuel nozzle;

e. a liner that circumferentially surrounds the combustion chamber;

d. a first annular passage that circumferentially surrounds the liner;

e. a second annular passage that circumferentially surrounds the first annular passage;

f. a fluid passage between the first annular passage and the second annular passage;

g. a plurality of fuel injectors circumferentially arranged around the liner, wherein the plurality of fuel injectors provide fluid communication from the second annular passage, through the liner, and into the combustion chamber; and h. a baffle inside the second annular passage.

16. The system as in claim 15, wherein the second annular passage is substantially coextensive with the first annular passage.

17. The system as in claim 15, wherein the baffle extends circumferentially around the first annular passage.

* * * * *